US005205707A

United States Patent [19]

Smith et al.

[11] Patent Number: 5,205,707

[45] Date of Patent: Apr. 27, 1993

[54] IORIC PUMP WITH CAST IMPELLER HOUSING REQUIRING THREE MACHINED SURFACES AND ONE CENTRAL PILOTING BORE TO CONTROL CRITICAL TOLERANCES

[75] Inventors: John E. Smith, Rochester Hills; Dennis N. Koenig, Jr., Waterford Township; William E. Ruhig, Jr., Sterling Heights, all of Mich.

[73] Assignee: Coltec Industries Inc., New York, N.Y.

[21] Appl. No.: 679,948

[22] Filed: Apr. 3, 1991

Related U.S. Application Data

[63] Continuation-in-part of Ser. No. 502,157, Mar. 28, 1990.

[51] Int. Cl.[5] ..... F03B 11/08

[52] U.S. Cl. ..... 415/121.2; 415/55.4; 415/214.1; 417/423.9; 210/416.1; 210/496

[58] Field of Search ..... 415/55.1, 55.2, 55.3, 415/55.4, 55.5, 121.2, 214.1; 417/423.9; 418/47; 210/416.1, 496; 29/888.02, 888.025, 407, 434, 527.6; 164/76.1

[56] References Cited

U.S. PATENT DOCUMENTS

| | | | |
|---|---|---|---|
| 2,265,112 | 12/1941 | Davies | 415/121.2 |
| 2,615,573 | 10/1952 | Storey | 210/496 |
| 2,696,789 | 12/1954 | Fabig | 415/55.1 |
| 3,238,707 | 3/1966 | Witkowski | 210/496 |
| 3,260,214 | 7/1966 | Goettl et al. | 415/121.2 |
| 3,266,229 | 8/1966 | Witkowski | 210/496 |
| 3,360,131 | 12/1967 | Witkowski | 210/496 |
| 3,748,066 | 7/1973 | Sully et al. | 415/121.2 |
| 3,844,674 | 10/1974 | Moriyama | 415/55.1 |
| 3,871,797 | 3/1975 | Igarashi et al. | 415/55.1 |
| 3,936,240 | 2/1976 | Dochterman | 415/55.1 |
| 4,231,718 | 11/1980 | Ruhl et al. | 415/55.1 |
| 5,024,578 | 6/1991 | Vansadia | 415/55.1 |

*Primary Examiner*—Edward K. Look
*Assistant Examiner*—Christopher Verdier
*Attorney, Agent, or Firm*—Howard S. Reiter

[57] ABSTRACT

A toric pump has a metal impeller housing formed with a flat end face into which an annular impeller receiving recess extends to a depth which exceeds the axial thickness of the impeller mounted in the recess by an amount only sufficient to provide a minimum operating clearance for the impeller sides when an impeller cover is mounted on the housing with a flat end face of the impeller cover in sealed face to face engagement with the flat end face of the housing. A bore in the impeller housing receives a cylindrical portion of the pump drive motor to accurately locate the rotary axis of the impeller with respect to the peripheral side surface of the stripper portion of the pump housing. All impeller-stripper portion clearances are established by machining of the die cast impeller housing and the formation of a flat surface on the impeller cover. A filter cover mounted upon the impeller cover cooperatively defines with the impeller cover an enclosed filter receiving chamber having an externally accessible inlet port opening into the chamber through the filter cover and a pump inlet passage opening from the filter chamber into a pump chamber recessed into the flat end face of the impeller cover. The impeller cover is formed with an externally accessible outlet port communicating with the pump chamber. A resilient block of filter media is enclosed in the filter chamber to filter air or other fluid flowing through the chamber from the inlet port to the pump inlet passage.

8 Claims, 7 Drawing Sheets

IORIC PUMP WITH CAST IMPELLER HOUSING REQUIRING THREE MACHINED SURFACES AND ONE CENTRAL PILOTING BORE TO CONTROL CRITICAL TOLERANCES

REFERENCE TO RELATED APPLICATION

The present application is a continuation-in-part of a commonly owned co-pending application serial number 07/502,157, filed Mar. 28, 1990.

BACKGROUND OF THE INVENTION

The present invention is directed to a toric pump incorporating an improved housing construction enabling a drive motor, pump and filter to be readily mass produced and assembled into a single compact package.

Although useful in other applications, the pump disclosed in the present application is especially designed to supply air to the exhaust emission control system of an automotive vehicle. As such, because of the large number of pumps required, part fabrication and assembly costs must be kept at a minimum. A toric pump such as that disclosed in the aforementioned parent application Ser. No. 07/502,157 is well adapted to produce the required air flow for the emission control system application by means of a pump of extremely compact size. The present invention is directed to structural features of such a pump which minimize part fabrication and assembly costs.

In a toric pump such as that disclosed in parent application Ser. No. 07/502,157, one critical dimension of the assembled pump is the axial clearance between the opposed side surfaces of the impeller and the adjacent wall surfaces of the pump housing and a second critical dimension is the radial clearance between the periphery of the impeller and the stripper portion of the impeller receiving chamber which separates the outlet end of the pump chamber from the inlet end. Clearance between the impeller and chamber walls at the stripper portion must be extremely close to minimize leakage from the high pressure region at the outlet end of the pump chamber to the relatively low pressure region at the inlet end of the pump chamber.

The present invention enables a precise establishment of housing to impeller clearance to be achieved by machining of a single part. The present invention also is designed for simple and efficient assembly.

SUMMARY OF THE INVENTION

A pump according to the present invention includes an impeller housing formed as a metal casting which is machined to finish certain surfaces to precise dimensional tolerances. These machined surfaces include a flat planar front end face of the housing, a flat bottom surface forming the bottom of a cup shaped impeller receiving recess in the front end face of the housing, a circular pump axis locating bore, and the stripper surface concentric with the axis locating bore. The flat end surface of the housing and the flat bottom surface of the impeller recess lie in parallel general planes, and the depth of the recess from the flat end surface of the housing to the bottom surface exceeds the axial thickness of the impeller to be placed in the recess by the total axial clearance desired between impeller and opposed housing side walls. The sole requirement of precision for the mating housing element which will cover the recess in the impeller housing is that it have an accurately flat surface which can be seated in face to face engagement with the front end face of the impeller housing so that impeller clearance is established by the depth of the recess in the housing. This last requirement may be easily met in a molded thermoplastic impeller cover. Such an impeller cover is readily formed with a pump chamber recessed into its flat surface to mate with the recess in the metal impeller housing.

The impeller housing is formed with a through bore concentric with the impeller recess of a diameter to establish a tight fit with a front motor boss of the pump drive motor (which boss carries a motor shaft bearing). The side (radial outer surfaces) of the stipper portion of the impeller recess is machined accurately concentric with this bore at a precise radial distance from the bore axis.

In accordance with the present invention, a cup shaped filter receiving recess is formed in that side of the impeller cover remote from the impeller housing. A passage extends through the impeller cover from the bottom of the filter receiving recess to open into the pump chamber at the inlet end of the pump chamber, while the outlet end of the pump chamber in the impeller cover communicates directly with an externally accessible pump outlet port formed on the impeller cover.

A cup shaped filter cover, likewise constituted by a molded thermoplastic part, is received upon the impeller cover to enclose and constitute an extension of the filter receiving recess in the impeller cover. The two covers are assembled by a screw which passes through the filter cover and a central post in its cup shaped recess to be threaded into the end of a central post in the filter receiving recess of the impeller cover. Vane-like webs extend radially from the central posts of the respective covers in substantial edge to edge engagement with each other to the outer wall of the filter receiving chamber defined by the assembled covers to constitute a barrier between an inlet port in the filter cover and the passage which connects the filter receiving recess in the impeller cover to the pump inlet end of the pump chamber. A resilient block of a sponge-like filter material is mounted in the filter receiving recess or chamber between the two assembled covers to filter air passing from the inlet port to the inlet end of the pump chamber via the passage in the impeller cover.

Other objects and features of the invention will become apparent by reference to the following specification and to the drawings.

IN THE DRAWINGS

DETAILED DESCRIPTION OF THE PREFERRED AND ALTERNATIVE EMBODIMENTS

Figure 1:
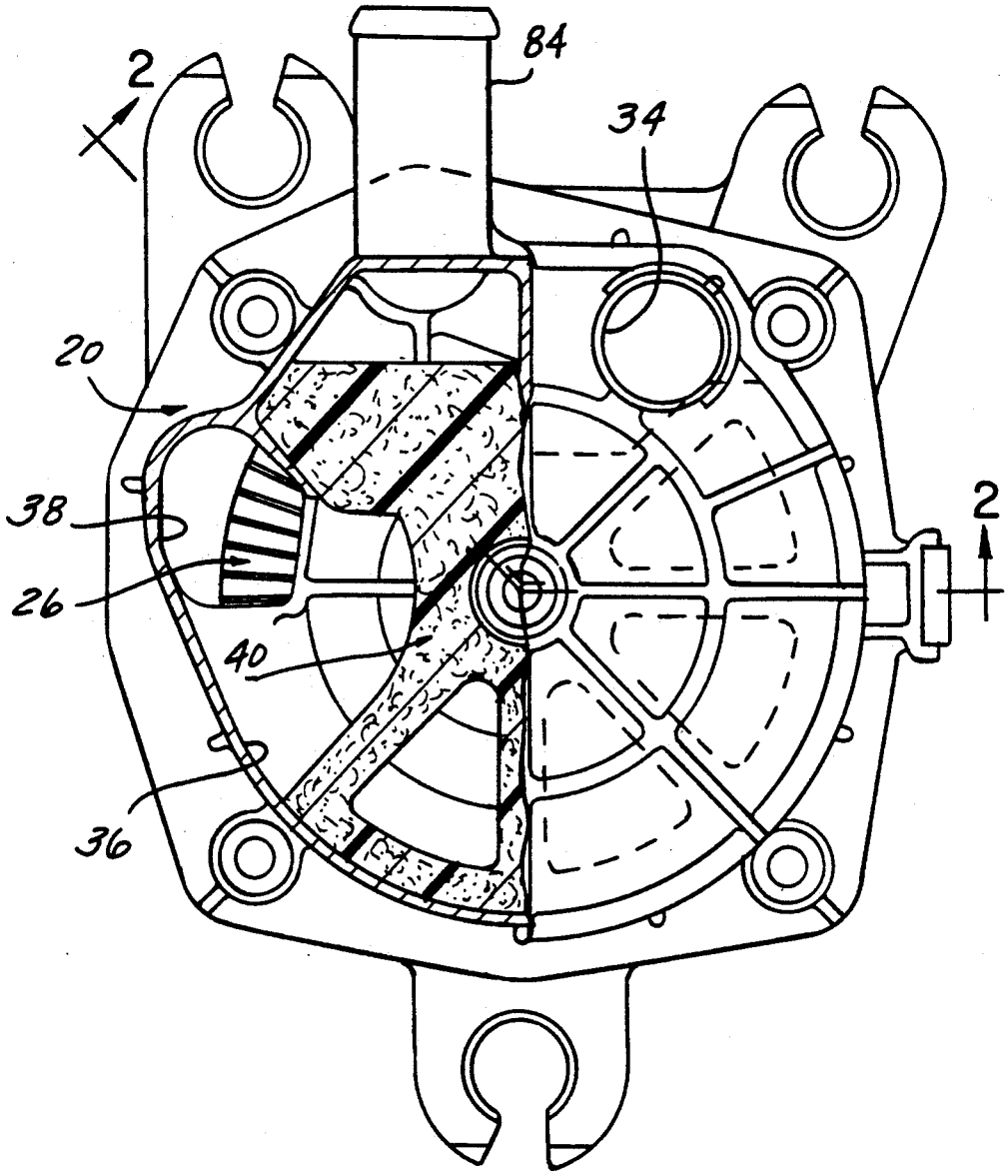
FIG. 1 is a front end view, with certain parts broken away, of a toric pump embodying the present invention.
Figure 2:
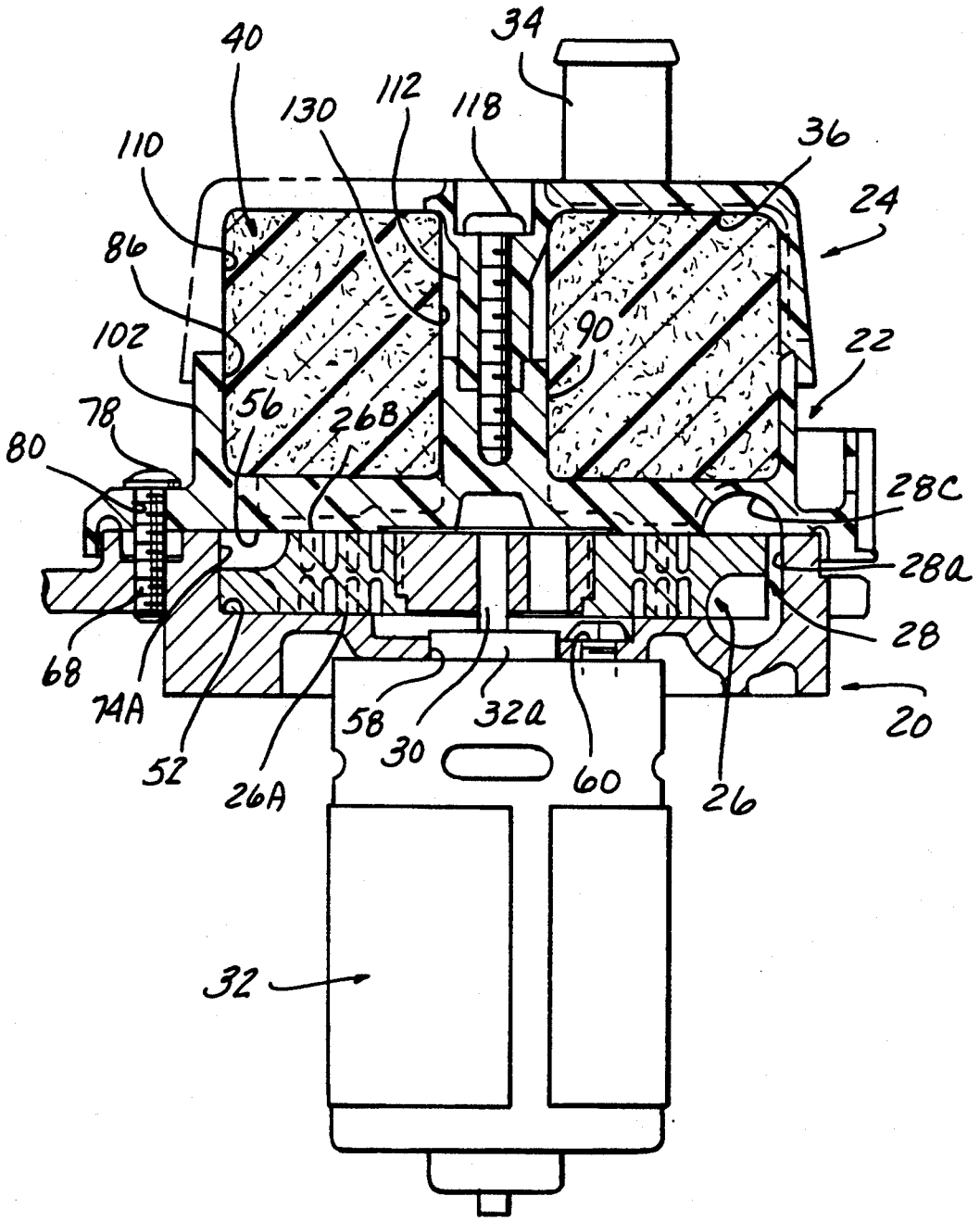
FIG. 2 is a detailed cross sectional view of the pump of FIG. 1 taken on line 2—2 of FIG. 1.

The interrelationship of the various parts of a toric pump embodying the present invention are best seen in the assembly views of FIGS. 1 and 2, while details of the individual parts are shown in FIGS. 3–16.

Referring first to FIGS. 1 and 2, a pump embodying the present invention includes an impeller housing designated generally 20, an impeller cover designated generally 22 mounted upon the front of housing 20, and a filter cover designated generally 24 mounted on the front of impeller cover 22. A pump impeller 26 is mounted in operative relationship with a pump chamber designated generally 28 cooperatively defined by the assembled impeller housing 20 and impeller cover 22, the impeller 26 being fixedly coupled to the drive shaft 30 (FIG. 2) of an electric motor 32 mounted or integrated with the rear of the impeller housing. An inlet port or fitting 34 opens through filter cover 24 into a filter chamber 36 defined by the assembled impeller cover and filter cover. A passage or opening in impeller cover 22 places the filter chamber 36 in communication with pump chamber 20, a sponge-like block of filter media 40 being fitted in filter chamber 36 between inlet port 34 and passage 38 to filter air passing into the pump through inlet port 34 before the air passes through passage 38 into pump chamber 28.

For purposes of the present application, the pump impeller 26 and the configuration of pump chamber 28 may be assumed to be identical to the impeller and pump chamber disclosed in parent application Ser. No. 07/502,157, and further details of the impeller and pump operation may be had from that application, whose disclosure is incorporated herein by reference. The invention of the present application is especially concerned with the configuration and interrelationship of impeller housing 20, impeller cover 22, filter cover 24 and filter element 40, details of which are set forth below.

Figure 3:
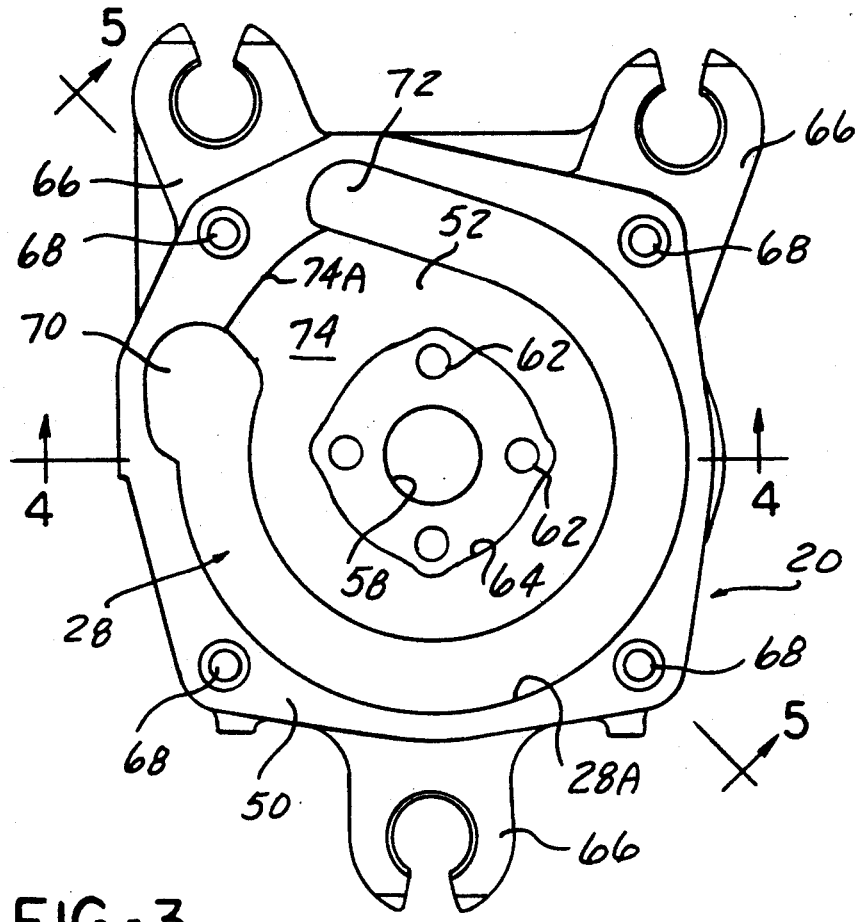
FIG. 3 is a front end view of the impeller housing of the pump of FIG. 1.
Figure 4:
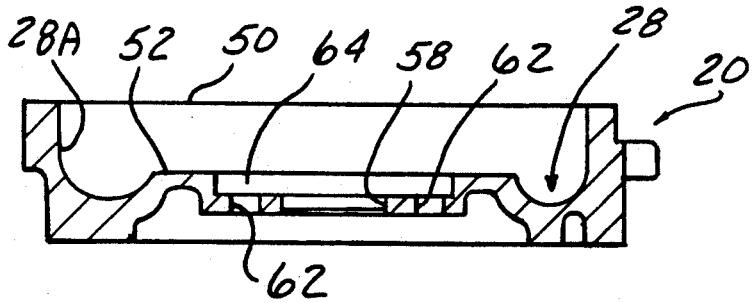
FIG. 4 is a detailed cross sectional view of the impeller housing taken on line 4—4 of FIG. 3.
Figure 5:
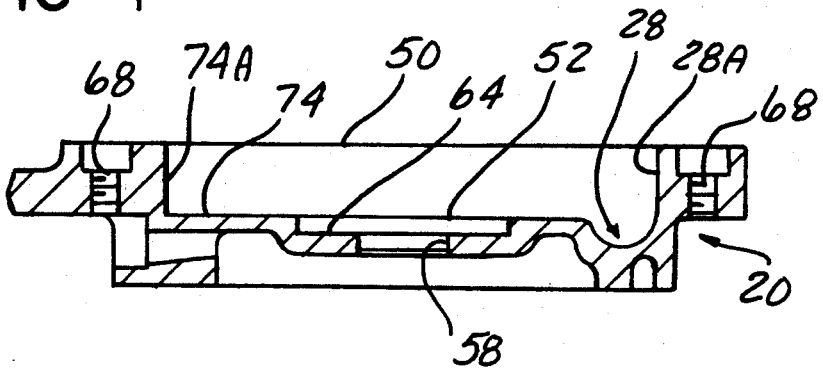
FIG. 5 is a detailed cross sectional view of the impeller housing taken on line 5—5 of FIG. 3.
Figure 6:
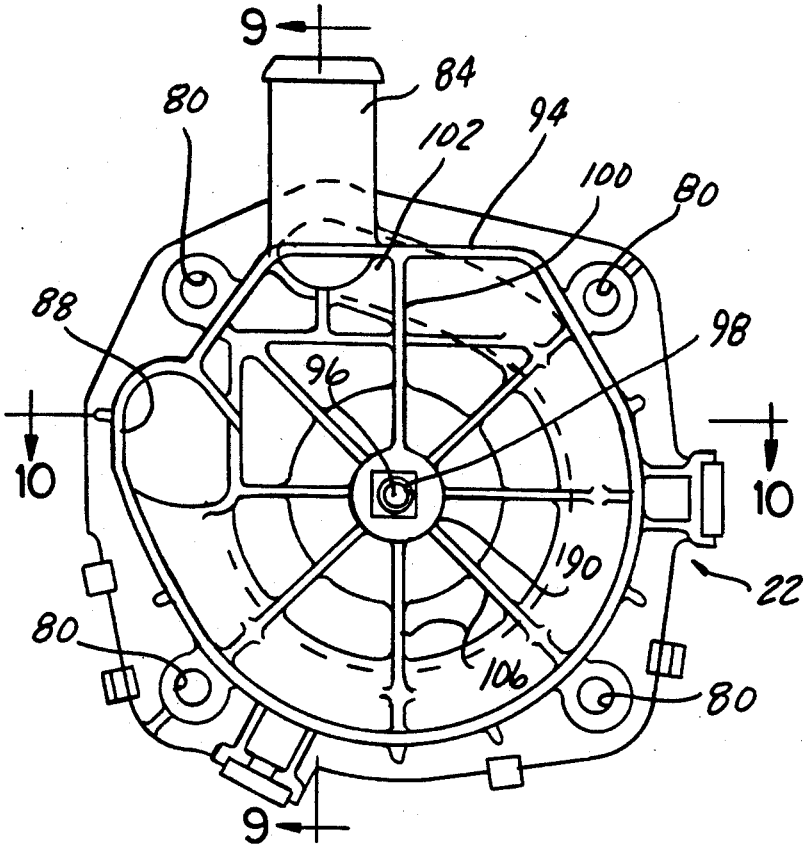
FIG. 6 is a front end view of the impeller cover of the pump of FIG. 1.

The construction of impeller housing 20 is best seen in FIGS. 3, 4 and 5. Housing 20 is initially formed as a metal casting with a portion of pump chamber 28 and an impeller receiving recess formed in the casting. Impeller housing 20, if die cast from a suitable material such as SAE 413 aluminum, will require, insofar as the present invention is concerned, the machined finishing of only two surfaces and the drilling and tapping of four holes for the reception of mounting bolts.

Referring to FIG. 4, two surfaces which require precise machining are what will be referred to as the front end surface 50 of housing 20 and a parallel surface 52 which defines the bottom of an impeller receiving recess in impeller housing 20. Surfaces 50 and 52 are finished accurately flat and parallel with each other and are spaced axially from each other by a distance which only slightly exceeds the axial thickness of the impeller 26 utilized. The amount by which the spacing between surfaces 50 and 52 exceeds the impeller thickness establishes the clearance between surface 52 and one side 26A (FIG. 2) of the impeller and between the opposite side 26B of the impeller and an opposed surface 56 of the impeller cover when the impeller, impeller housing and impeller cover are assembled as in FIG. 2. These clearances must be sufficient to avoid rubbing between the impeller sides and housing elements during rotation of the impeller, while at the same time being small enough to minimize any flow of air between the last mentioned opposed surfaces.

A central bore 58 through the impeller housing serves to pilot the front motor boss 32*a* of motor 32 which carries a shaft bearing, not shown, which locates the axis of motor shaft relative to the impeller housing. The location and diameter of bore 58 and the radius of stripper surface 74*a* are the other dimensions (other than surfaces 50 and 52) of housing 20 which must be machined to tight tolerances. The radial outer surface 28*a* of the pump chamber portion of the recess may be established with sufficient precision by the die casting process. Alternatively, bore 58 may receive a shaft bearing directly, rather than a boss on the motor housing in which the shaft bearing is located. Bore 58 establishes the location of the motor shaft axis relative to the housing, and stripper surface 74*a* is machined at a precise distance from and concentric to this axis to establish radial clearance between impeller and housing across the stripper. The diameter of bore 58 is such as to receive the motor boss (or shaft bearing) with a transition or locational interference fit. The motor housing is fixedly attached to the rear side of the impeller housing as by bolts 60 (FIG. 2) which pass through bores 62 at the bottom of a central recess 64. Mounting lugs 66 may be integrally formed on housing 20 to enable the pump to be mounted on a suitable mounting bracket. Tapped bores 68 (FIGS. 3 and 5) are formed in housing 20 to accommodate mounting bolts employed to mount impeller cover 22 on impeller housing 20.

As is conventional in toric pumps, the pump chamber 28 extends circumferentially about the axis of the impeller from an inlet end 70 (FIG. 3) to an outlet end 72. The recessed inlet and outlet ends 70, 72 are separated from each other by a stripper portion 74 of surface 52 which, when the impeller is in place, cooperates with the adjacent side surface of the impeller to form a flow restriction between the two surfaces functionally equivalent to a seal between the inlet and outlet. This prevents high pressure air at outlet 72 from flowing across the stripper portion 74 to the low pressure region at inlet end 70.

Figure 7:
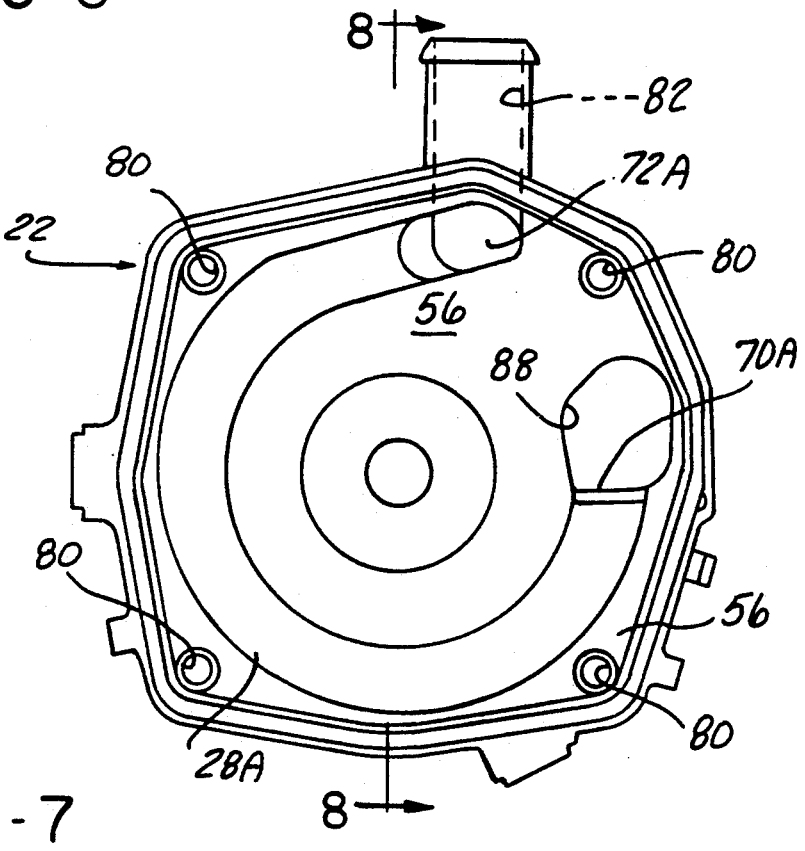
FIG. 7 is a rear end view of the impeller cover.
Figure 8:
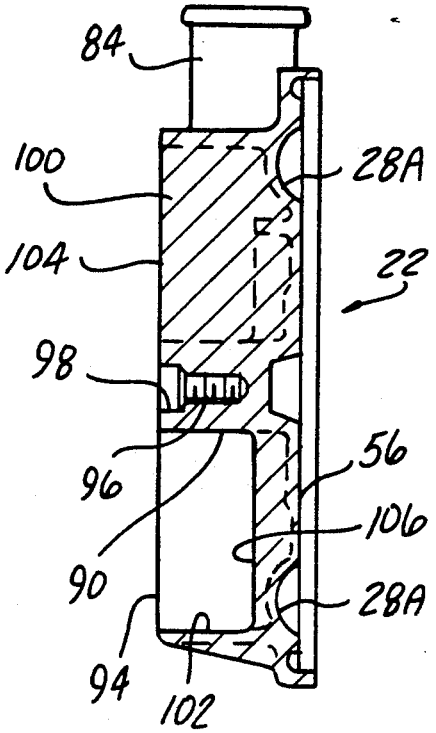
FIG. 8 is a detailed cross sectional view taken on the line 8—8 of FIG. 7.
Figure 9:
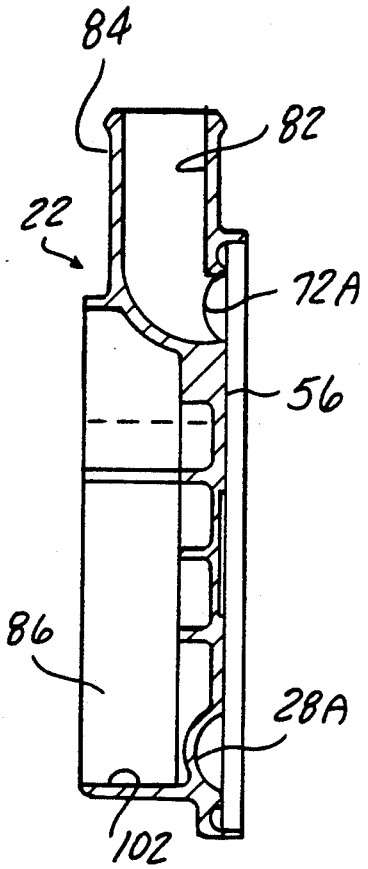
FIG. 9 is a detailed cross sectional view of the impeller cover taken on line 9—9 of FIG. 6.
Figure 10:
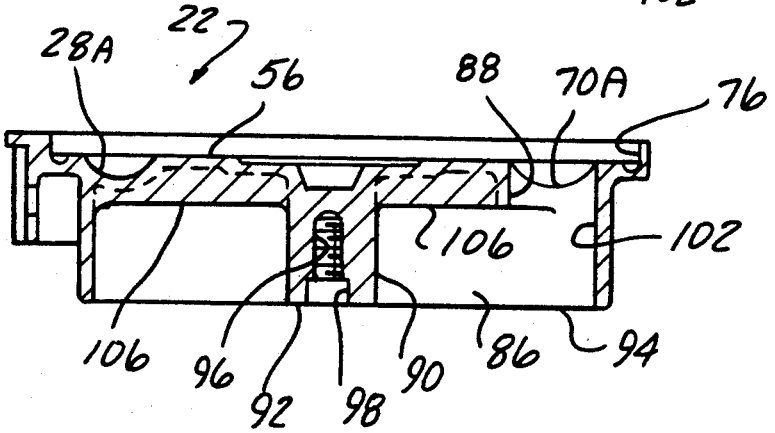
FIG. 10 is a detailed cross sectional view of the impeller cover taken on line 10—10 of FIG. 6.
Figure 11:
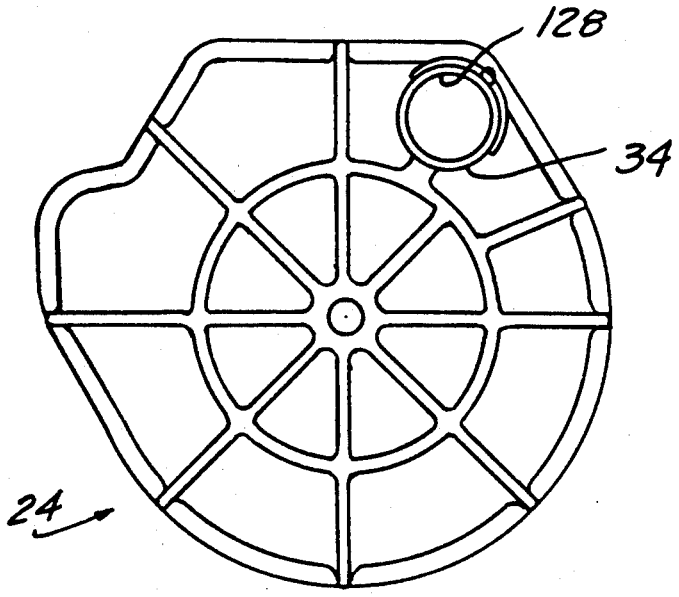
FIG. 11 is a front end view of a filter cover of the pump of FIG. 1.
Figure 12:
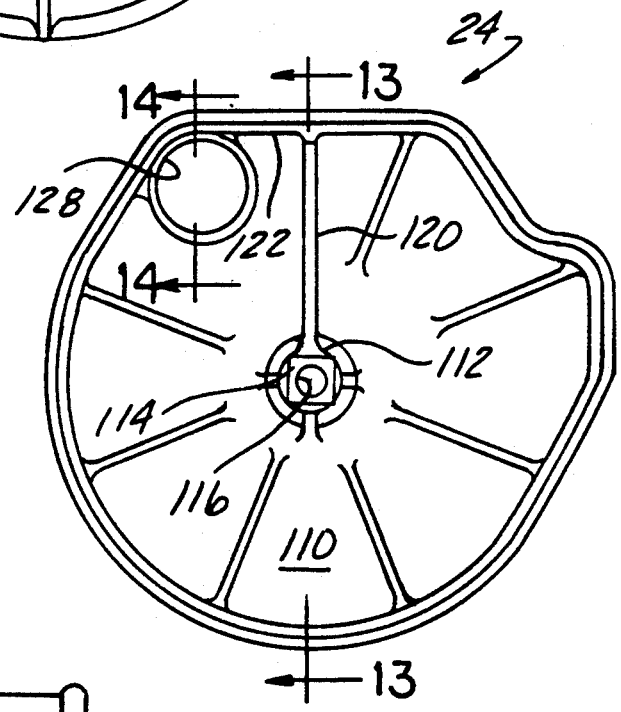
FIG. 12 is a rear end view of the filter cover.

The structure of impeller cover 22 is best seen in FIGS. 6–10. Impeller cover 22 is a molded one-piece part of a suitable thermoplastic material. The flat surface 56 referred to above is formed on the rear side of impeller cover 22 to be seated in face to face engagement with the machined surface 50 of impeller housing 20. An annular recess 28A in the flat rear surface 56 forms a pump chamber portion in the rear surface of impeller housing 22 which is coextensive with and matched to pump chamber 28 of housing 20. As best seen in FIGS. 9 and 10, the flat rear surface 56 of the impeller cover is recessed slightly to form an axially projecting peripheral flange 76 which fits over the front end of impeller housing 20 to locate the housing and cover relative to each other upon assembly. As best seen in FIG. 2, bolts 78 passing through bores 80 in impeller cover 22 are received in the tapped bore 68 in impeller housing 20 to fixedly secure housing 20 and cover 22 into assembled relationship with each other. As best seen in FIGS. 7 and 9, the outlet end 72A of the pump chamber portion 28A communicates with a passage 82 extending through a nipple 84 on impeller cover 22 to define an outlet port for the pump chamber 28, 28A of the pump.

At the front side of impeller cover 22, a cup shaped recess 86, best seen in FIGS. 9 and 10, is formed. A flow passage 88 leads rearwardly from the bottom of recess 86 to open through the flat rear surface 56 of the impeller cover. Passage 88 opens into the inlet end 70A of the pump chamber portion 28A in impeller cover 22 and constitutes the inlet to the combined pump chamber 28, 28A of the pump defined by the assembled housing 20 and cover 22. A central post 90 is integrally formed on cover 22 within the recess 86 and projects forwardly to a flat front end 92 co-planar with the front end edge 94 of cover 22. A bore 96 for receiving a self tapping mounting screw extends rearwardly into post 90, with a square recess 98 at the front end of bore 96. A radially extending web 100 (FIGS. 6 and 8) projects radially from central post 90 entirely across recess 86 to be integrally joined to the side wall 102 of the recess. The forward edge 104 (FIG. 8) of Web 100 is co-planar with the front edge 94 of the impeller cover. Other stiffening webs such as 106 may be formed at appropriate locations in recess 86 but, as best seen in FIG. 8, these other webs 106 have edges which are spaced well rearwardly of front edge 94. Recess 86 constitutes a portion of a filter chamber adapted to receive filter 40 (see FIG. 2).

Figure 13:
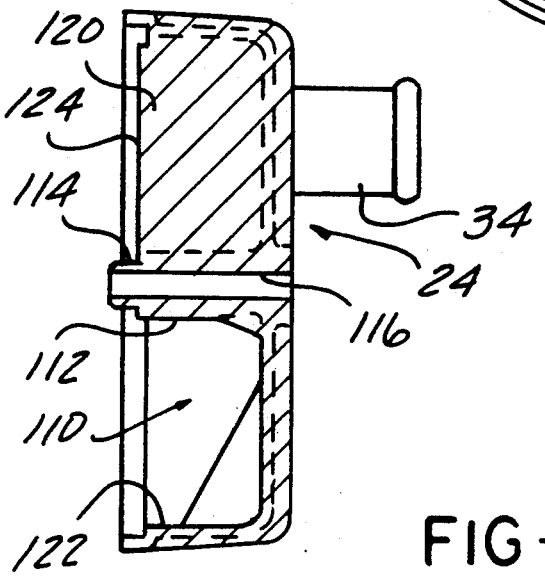
FIG. 13 is a detailed cross sectional view of the filter cover taken on line 13—13 of FIG. 12.
Figure 14:
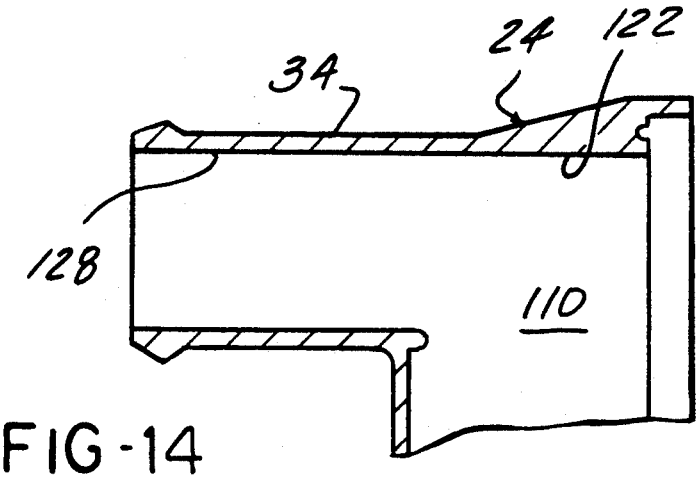
FIG. 14 is a detailed cross sectional view taken on line 14—14 of FIG. 12.
Figure 15:
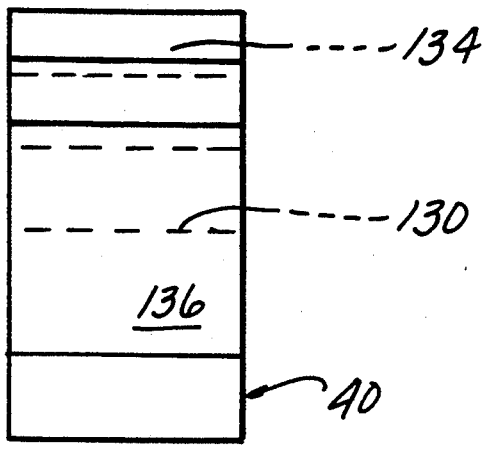
FIG. 15 is a side elevational view of a filter element utilized in the pump of FIG. 1.

The structure of filter cover 24 is best seen in FIGS. 11–14. Like impeller cover 22, filter cover 24 may be conveniently formed of a molded thermoplastic material. Cover 24, as best seen in FIG. 13, is of a generally cup shaped configuration, the recess 110 of the cup opening rearwardly or toward the viewer as viewed in FIG. 12. The recess 110 in filter cover 24 is conformed to mate with and form an extension of the filter receiving recess 86 of impeller cover 22, seen in FIG. 2. Like impeller cover 22, a central post 112 is formed in the filter receiving recess 110. The distal end of post 112 is formed with a square projection 114 adapted to be received within the square recess 98 in the post 90 of impeller cover 22. A bore 116 through post 112 receives a mounting bolt 118 threaded into bore 96 in the impeller cover to hold the filter cover seated upon impeller cover 22. As in the impeller cover, a radially extending web projects radially outwardly from post 112 to the side wall 122 of recess 110 of the filter cover, the rear edge 124 of web 120 being adapted to substantially engage edge 104 of web 100 of the impeller cover 22 when the impeller and filter covers are assembled to each other. A nipple 34 projecting forwardly from filter cover 24 is formed with an internal passage 128 opening into recess 110, the nipple and passage 128 constituting an inlet port to the pump assembly. Passage 128 is so located circumferentially of filter cover 24 that when the filter cover is assembled upon impeller cover 22 and the radial webs 120 of cover 24 and 100 of impeller cover 22 are in substantial edge to edge engagement with each other, the two webs define a barrier which is located between passage 128 in filter cover 24 and flow passage 88 in impeller cover 22.

Figure 16:
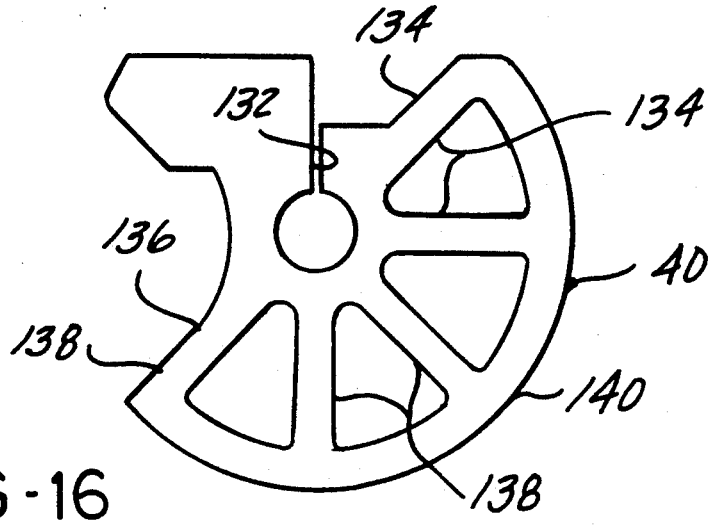
FIG. 16 is an end view of the filter element.

Referring now to FIG. 16, a filter element designated generally 40 is formed from a block of a sponge-like material, such as a reticulated polyester foam. The axial thickness of filter element 40 is chosen to slightly exceed the axial dimension of the filter chamber defined by the mated filter receiving recesses 86, 110 of the impeller cover 22 and filter cover 24 when the two covers are assembled. Filter element 40 is formed with a central bore 130 adapted to receive central posts 90 and 112 (see FIG. 2) and a lengthwise slit 132 extending axially through the filter and radially outwardly from bore 130 enables the webs 120 of filter cover 24 and 100 of impeller cover 22 to pass axially through the filter. The peripheral configuration of filter element 40 includes a first peripheral recess 134 located, when web 140 of filter cover 24 is received in slit 132, to be aligned with inlet passage 128 of the cover. Another recess 136 in the periphery of filter element 40 is located to be aligned with flow passage 88 in impeller cover 22 when web 100 of the impeller cover is received within slit 132. As viewed in FIG. 2, with the filter mounted in between the assembled filter cover 24 and impeller cover 22, air entering through nipple 34 and passage 128 flows axially into the recess 134 of the filter element but, as viewed in FIG. 16, cannot flow in a counterclockwise direction from that recess because the webs 120 and 100 form a barrier to such flow. Instead, the air must flow from recess 134 through the filter in a clockwise direction about central bore 130 through the radially extending spoke-like web portions 138 of filter element 40 to the recess 136 from which the filtered air can flow through flow passage 88 (FIGS. 6, 7, and 10) into the pump chamber. That portion of filter element 40 between recess 134 and 136 is formed with a peripheral side surface 140 lying at a constant radial distance from the axis of bore 130 which is so dimensioned to be resiliently engaged with the corresponding cylindrically configured portions of side walls 86 and 102 of the impeller and filter cover recesses.

It will be noted that the impeller housing 20 may be disassembled from impeller cover 22 to provide access to impeller 26 without requiring disassembly of the filter cover 24 from impeller cover 22 or requiring disconnection of external hoses (not shown) coupled to inlet nipple 34 and to outlet nipple 84. Similarly, replacement of filter element 40 requires only removal of filter cover 24 from impeller cover 22 by removal of mounting bolt 118 and, again, does not require any disconnection of external hoses. The only requirement for precision in fabricating the parts is to machine two surfaces—surfaces 50 and 52 of the impeller housing—flat and at an accurately axially spaced relationship to each other, this act establishing all of the required impeller to housing clearances.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

What is claimed is:

1. A toric pump comprising an impeller housing having a front end face lying in a first general plane and a cup shaped impeller receiving recess in said front end face having a bottom surface lying in a second general plane parallel to said first general plane, said recess having a central axis normal to said first and second general planes, an impeller received in said impeller receiving recess for rotation about said axis, said impeller having front and rear side surfaces lying in parallel general planes normal to said axis and disposed between and respectively closely adjacent to said first and second general planes, an impeller cover having a front face and a flat rear face disposed in sealed face to face engagement with said front end face of said housing around the periphery of said impeller receiving recess, means defining a pump chamber in said rear face of said impeller cover cooperable with said impeller and extending circumferentially of said axis from an inlet end to an outlet end circumferentially separated from said inlet end by a stripper portion of said rear face, said impeller cover having externally accessible outlet port means in fluid communication with said outlet end of said pump chamber, means defining a generally cup shaped filter receiving recess in said front face of said cover having an inlet passage opening from said filter receiving recess into said pump chamber at said inlet end, a filter cover mounted on said front face of said impeller cover in overlying relation to said filter receiving recess and sealingly engaged with said front face around the periphery of said filter receiving recess, means defining an externally accessible inlet port in said filter cover opening into said filter receiving recess at a location remote from said inlet end in said impeller cover, and filter means resiliently gripped between said filter cover and said impeller cover between said inlet port and said inlet passage.

2. The invention defined in claim 1 wherein said housing includes a rear wall defining said bottom surface of said impeller receiving recess, drive motor means mounted on said rear wall at a rearward side thereof and having a rotatable drive shaft projecting through said rear wall coaxially of said axis, and means fixedly mounting said impeller upon a forward end of said drive shaft.

3. The invention defined in claim 1 wherein said impeller housing is of metal, and said impeller cover is of a molded thermoplastic material.

4. The invention defined in claim 1 wherein said impeller cover includes a first central post integrally formed on said impeller cover extending coaxially of said axis within said filter receiving recess to an end surface lying substantially in said first general plane, a first web lying in a first general radial plane containing said axis integral with and projecting radially outwardly from said first post to the side wall of said filter receiving recess at a location between said inlet passage in said impeller cover and said inlet port in said filter cover, said filter means comprising a block of resilient filter media having a central bore therethrough adapted to receive said first post and a slit extending radially outwardly from said bore adapted to receive said web.

5. The invention defined in claim 4 wherein said filter receiving recess is defined in part by a first side wall portion lying at a constant radial distance from said axis and extending circumferentially about said axis over an arc of approximately 180°, said inlet passage being located beyond one end of said first side wall portion and said inlet port in said filter cover being located beyond the other end of said first side wall portion, said block of filter media having a cylindrical side wall portion resiliently engaged with said first side wall portion of said filter receiving recess, said inlet port opening into said filter receiving recess between said web and said other end of said first side wall portion.

6. The invention defined in claim 1 wherein said filter cover has a rearwardly opening cup shaped filter receiving recess adapted to mate with and constitute an axially forward extension of said filter receiving recess in said impeller cover when said filter cover is mounted on said impeller cover, a second central post integral with said filter cover extending coaxially of said axis within said filter receiving recess in said filter cover to abut said end surface of said first central post of said impeller cover, and a second web lying in a second general radial plane integral with and projecting radially outwardly from said second post to the side wall of the filter receiving recess in said filter cover, said first and second webs having radially extending edges in substantial engagement with each other when said filter cover is mounted on said impeller cover to cooperatively define a barrier extending radially across the filter receiving recess between said inlet port in said filter cover and said inlet end in said impeller housing.

7. The invention defined in claim 6 wherein said filter means comprises a block of resilient filter media of an axial length greater than that of an extended filter receiving recess defined by the mating filter receiving recesses in said impeller and filter covers, said block of media having a central bore receiving the central posts of said impeller cover and filter cover and a slit extending the entire axial length of said block and radially outwardly from said bore receiving said first and second webs of said impeller and filter covers, said block being sealingly engaged with the side wall of said extended filter receiving recess at a location at an opposite side of said inlet port from the engaged first and second webs.

8. The invention defined in claim 7 wherein said block of filter media is formed with a plurality of spaced axially extending openings therethrough.

* * * * *

UNITED STATES PATENT AND TRADEMARK OFFICE

CERTIFICATE OF CORRECTION

PATENT NO. : 5,205,707

DATED : April 27, 1993

INVENTOR(S) : John E. Smith, et al

It is certified that error appears in the above-indentified patent and that said Letters Patent is hereby corrected as shown below:

On the title page, item [54] and column 1, line 2, change "IORIC" to --TORIC--.

Signed and Sealed this

Twenty-fifth Day of January, 1994

*Attest:*

Bruce Lehman

BRUCE LEHMAN

*Attesting Officer*

*Commissioner of Patents and Trademarks*